US009587337B2

(12) United States Patent
He et al.

(10) Patent No.: US 9,587,337 B2
(45) Date of Patent: Mar. 7, 2017

(54) WASHING METHOD WITH POLYMER SOLID PARTICLES

(75) Inventors: Zhengbao He, Laoshan Qingdao (CN); Chunfeng Lao, Laoshan Qingdao (CN); Guojun Ma, Laoshan Qingdao (CN)

(73) Assignee: Xeros Limited, Rotherham (GB)

( * ) Notice: Subject to any disclaimer, the term of this patent is extended or adjusted under 35 U.S.C. 154(b) by 213 days.

(21) Appl. No.: 14/125,344

(22) PCT Filed: Nov. 11, 2011

(86) PCT No.: PCT/CN2011/082090
§ 371 (c)(1),
(2), (4) Date: Dec. 11, 2013

(87) PCT Pub. No.: WO2012/171296
PCT Pub. Date: Dec. 20, 2012

(65) Prior Publication Data

US 2014/0123402 A1 May 8, 2014

(30) Foreign Application Priority Data

Jun. 15, 2011 (CN) ..... 2011 1 0160137

(51) Int. Cl.

| | |
|---|---|
| ***D06F 23/00*** | (2006.01) |
| ***D06F 35/00*** | (2006.01) |
| ***D06F 39/02*** | (2006.01) |
| ***D06F 39/10*** | (2006.01) |

(52) U.S. Cl.
CPC ..... *D06F 23/00* (2013.01); *D06F 35/00* (2013.01)

(58) Field of Classification Search
CPC ..... D06F 23/00; D06F 35/00; D06F 35/005; D06F 35/006; D06F 35/007; D06F 39/02; D06F 39/10
See application file for complete search history.

(56) References Cited

U.S. PATENT DOCUMENTS

| | | | | |
|---|---|---|---|---|
| 4,388,077 | A * | 6/1983 | Ruck | C11D 1/90 510/329 |
| 2005/0160771 | A1* | 7/2005 | Hosoito | D06F 37/304 68/12.16 |
| 2008/0189873 | A1 | 8/2008 | De Dominicis et al. | |
| 2011/0296628 | A1 | 12/2011 | Jenkins et al. | |
| 2012/0284931 | A1 | 11/2012 | Jenkins et al. | |

FOREIGN PATENT DOCUMENTS

| | | | |
|---|---|---|---|
| CN | 2291428 | Y | 9/1998 |
| CN | 2892930 | * | 4/2007 |
| CN | 101466482 | A | 6/2009 |
| CN | 201424587 | * | 3/2010 |
| CN | 101886321 | A | 11/2010 |
| CN | 10261589 | A | 5/2011 |
| CN | 102061588 | A | 5/2011 |
| EP | 1 712 612 | A1 | 10/2006 |
| EP | 2 135 989 | A1 | 12/2009 |
| WO | WO 2005/124006 | * | 12/2005 |
| WO | 2010/094959 | A1 | 8/2010 |
| WO | 2011/064581 | A1 | 6/2011 |

OTHER PUBLICATIONS https://www.youtube.com/watch?v=OCKro-yy7CI Auntieco Aug. 1, 2009.*

International Search Report (PCT/ISA/210) mailed on Mar. 22, 2012, by the Chinese Patent Office as the International Searching Authority for International Application No. PCT/CN2011/082090.

* cited by examiner

*Primary Examiner* — Amina Khan
(74) *Attorney, Agent, or Firm* — Clark & Elbing LLP

(57) ABSTRACT

A washing method with polymer solid particles comprises: step 1: washing clothes with the polymer solid particles, the surface of said polymer solid particles is provided with absorption holes; step 2: dehydrating the polymer solid particles and the clothes together; step 3: separating the polymer solid particles from the clothes and collecting the polymer solid particles; step 4: rinsing the clothes; and step 5: dehydrating the clothes. Before separating the polymer solid particles from the clothes, there is a step of dehydrating the polymer solid particles and the clothes together, so the user can easily separate the polymer solid particles from the clothes.

19 Claims, 3 Drawing Sheets

WASHING METHOD WITH POLYMER SOLID PARTICLES

FIELD OF THE INVENTION

The invention relates to the technical field of washing, in particular to a washing method using polymer solid particles.

BACKGROUND OF THE INVENTION

The washing medium in the washing process is as follows: 1、using water as the washing medium; 2、using organic solvent as medium, and this method is suitable for removing the hydrophobic stain; 3、using air, such as using the liquid $CO_2$; 4、using plastic particles, such as the Chinese Patent CN 101466482A, with the publication date of Jun. 24, 2009, discloses a new washing method, the method use the nylon plastic particles as scrubbing medium and adsorbes the stains on the clothes by the polar groups in the surface of nylon, such as —OH, the method is the latest R & D results, the method is easier to remove the hydrophobic stains compared with using water as the washing medium, and has less environmental pollution and convenient operation compared with using organic solvent and liquid air as washing medium.

The washing method using polymer solid particles is similar to the general washing method using water, which includes the steps of washing, rinsing and dewatering, but the difference is that the polymer solid particles are not easily separated because it tend to be adsorbed on the surface of clothes under the conditions that the clothes is wet.

SUMMARY OF THE INVENTION

In order to overcome the disadvantages that the polymer solid particles are not easily separated in the process of washing clothes, the invention provides a washing method using polymer solid particles, the washing method of invention can easily separate the polymer solid particles from the clothes.

In order to solve the technical problem of the invention, the following technical solution is used:

A washing method with polymer solid particles, the method comprising:

step 1: washing clothes with the polymer solid particles, wherein the surface of said polymer solid particles is provided with absorption holes;

step 2: dehydrating the polymer solid particles and the clothes together;

step 3: separating the polymer solid particles from the clothes and collecting the polymer solid particles;

step 4: rinsing the clothes; and step 5: dehydrating the clothes.

When the clothes is wet, the polymer solid particles is easily absorbed on the surface of clothes due to the surface tension and Van der Waals forces. Therefor it is easy to separate the clothes and the polymer solid particles after dehydrating the polymer solid particles and the clothes together.

Preferably, the washing method further comprises another step of adding water and detergent into the polymer solid particles and the clothes before step 1.

Preferably, the rotational speed of washing in step 1 is in the range of 50-70 rpm.

Preferably, the washing time in step 1 is in the range of 15-60 minutes.

Preferably, said polymer solid particles in the step 1 contains 5%~10% magnetic material.

Preferably, the washing time in step 1 is in the range of 30-50 minutes.

Preferably, the washing time in step 1 is of 40 minutes.

Preferably, the washing is in cold water.

Preferably, the speed of the inner cylinder is in the range of 1000-2000 rpm during dehydrating in step 2.

Preferably, the polymer solid particles and the clothes are separated in a magnetic field in step 3.

Preferably, the speed of the inner cylinder is in the range of 200-600 rpm during collecting the polymer solid particles in step 3.

Preferably, the rinsing time in step 4 is in the range of 3~10 minutes.

Preferably, the washing method further comprises a step of separating the polymer solid particles remained in clothes between step 3 and step 4.

Preferably, separating the polymer solid particles remained in the clothes includes circulating the following steps: the inner cylinder of the washing device drives the clothes rotate a preset angle, and then the inner cylinder stops rotating a preset time.

Preferably, the times of circulating is of 1-50.

Preferably, the inner cylinder of the washing device drives the clothes to rotate unidirectionally; or the inner cylinder of the washing device drives the clothes to rotate alternately along clockwise and anticlockwise; or the inner cylinder of the washing device drives the clothes to rotate unidirectionally, and then the inner cylinder of the washing device drives the clothes to rotate alternately along clockwise and anticlockwise.

Preferably, the rotation angle that inner cylinder of the washing device drives the clothes is in the range of 0°~150°.

Preferably, the stop time of the inner cylinder is in the range of 1~5 seconds.

Preferably, the washing method further comprises a step of collecting the polymer solid particles after the step of separating the polymer solid particles remained in clothes.

A washing method with polymer solid particles, the washing method comprising:

step 1: washing the clothes with polymer solid particles, wherein the surface of the polymer solid particles is provided with absorption holes;

step 2: dehydrating the polymer solid particles and the clothes together;

step 3: separating the polymer solid particles from the clothes and collecting the polymer solid particles;

step 4: determining whether to repeat the step 3, if yes, repeating the step 3 at least once.

Preferably, said solid particles in the step 1 contains 5%~10% magnetic material.

Preferably, the polymer solid particles and the clothes are separated in a magnetic field in step 3.

Preferably, the speed of the inner cylinder is in the range of 200-600 rpm during collecting the polymer solid particles in step 3.

The advantageous effect of the invention is: Before separating the polymer solid particles from the clothes, there is a step of dehydrating the polymer solid particles and the clothes together, so the user can easily separate the polymer solid particles from the clothes.

BRIEF DESCRIPTION OF THE DRAWINGS

The washing method with polymer solid particles of the invention will now be described in detail with reference to the accompanying drawings.

In which: 1—the valve, 2—the polymer solid particles, 14—the scraper, 15—the electromagnet, 5—the particles storage box, 51—an outlet of particles storage box, 52—the inlet of particles storage box, 6—the outer cylinder, 61—the inlet of particles in outer cylinder, 62—the outlet of particles in outer cylinder, 7—the shell of washing machine, 8—the inner cylinder.

DETAILED DESCRIPTION OF THE INVENTION

Example 1

Figure 1:
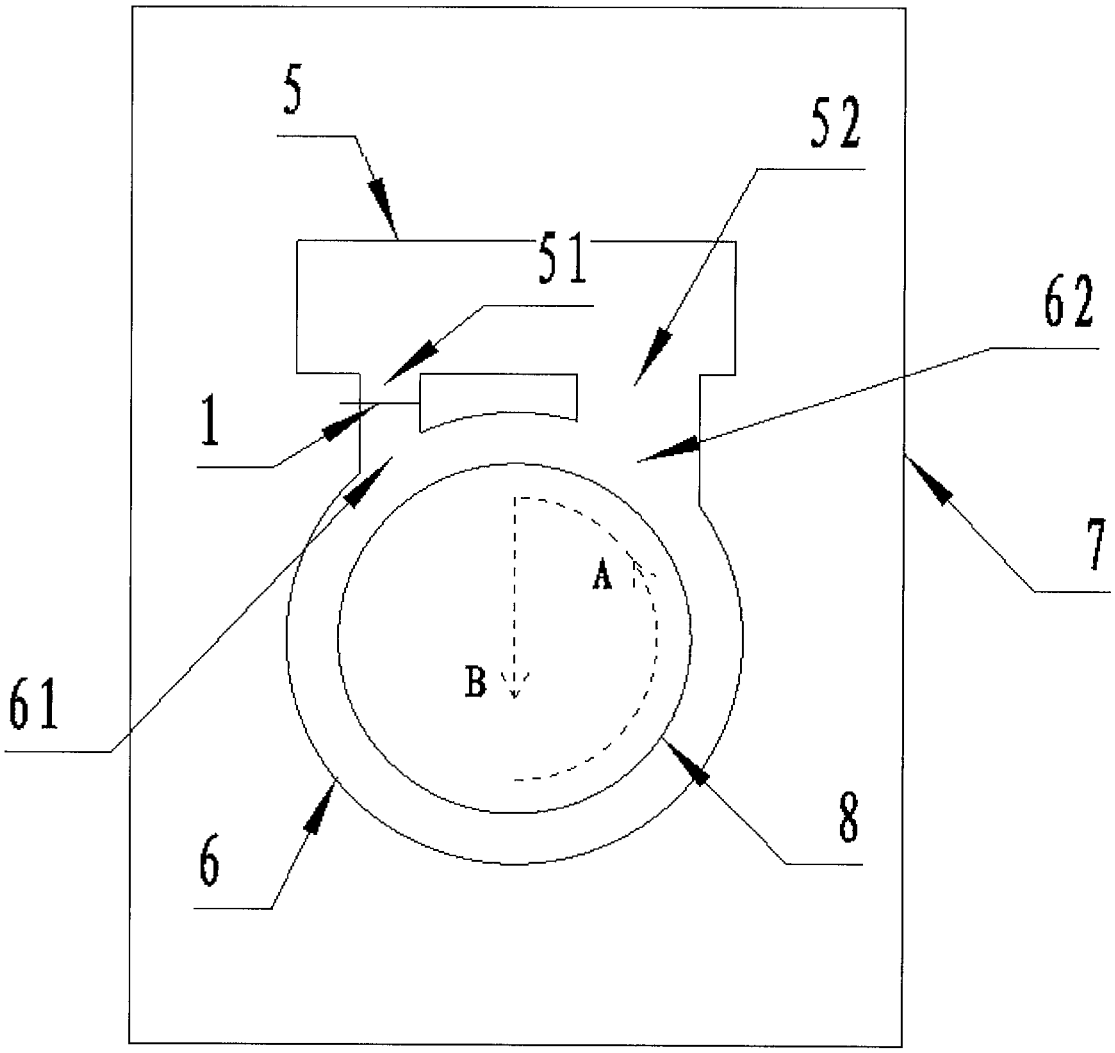
FIG. 1: the schematic illustration of the washing method with polymer solid particles in the example 1 of the invention.

The polymer solid particles are used for washing clothes in this example, the washing machine of the present example is as shown in FIG. 1, an outer cylinder 6 and an inner cylinder 8 is positioned in a shell 7, a particles storage box 5 is arranged on the top of the outer cylinder 6, an outlet of particles storage box 51 of the particles storage box 5 is connected with an inlet of particles in outer cylinder 61 of the outer cylinder 6 by a valve 1, a inlet of particles storage box 52 of the particles storage box 5 is connected with an outlet of particles in outer cylinder 62 of the outer cylinder 6.

The washing method with polymer solid particles in the present example main comprises:

step 1: washing clothes with the polymer solid particles, wherein the surface of said polymer solid particles is provided with absorption holes;

step 2: dehydrating the polymer solid particles and the clothes together;

step 3: separating the polymer solid particles from the clothes and collecting the polymer solid particles;

step 4: rinsing the clothes; and step 5: dehydrating the clothes.

Figure 2:
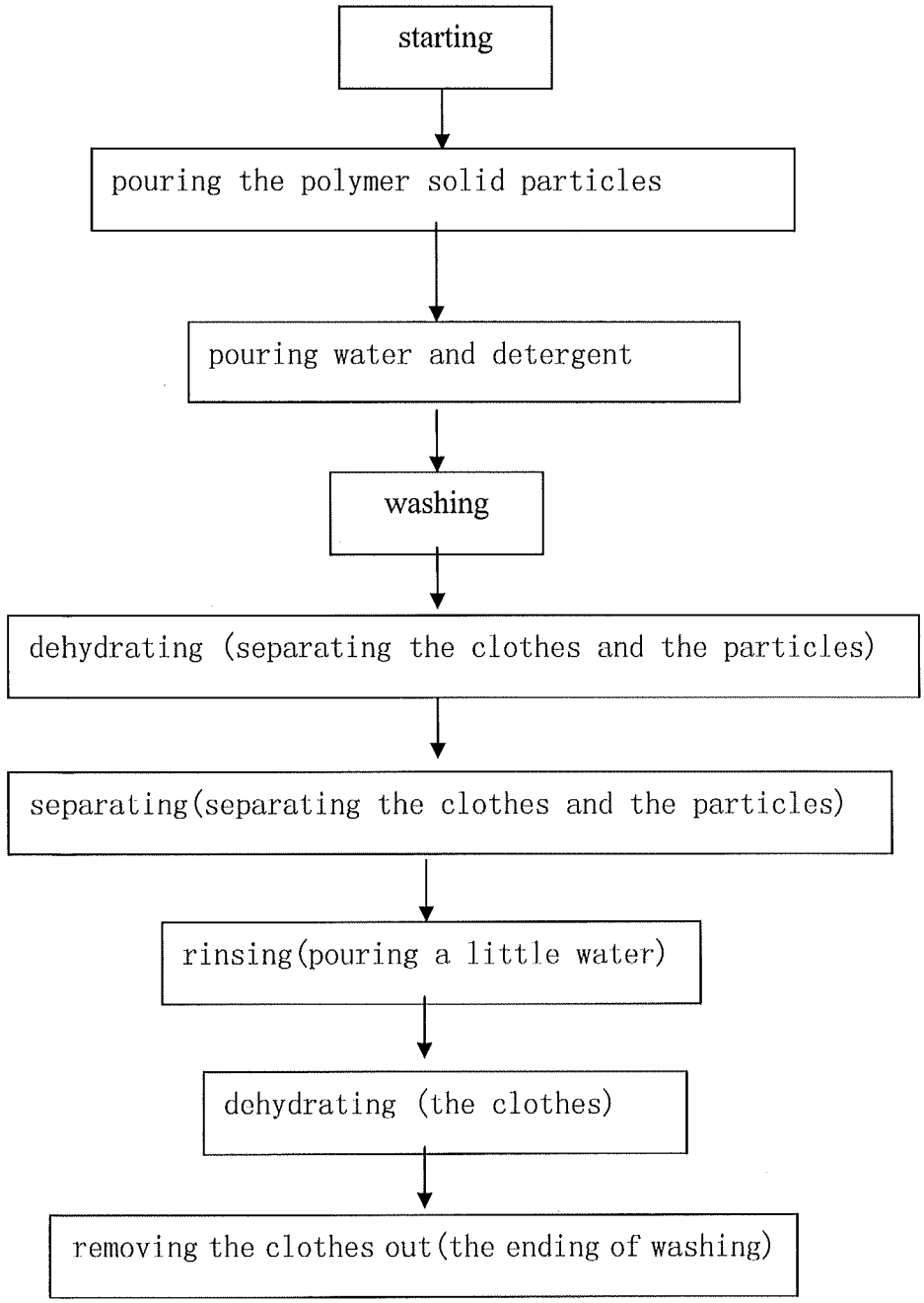
FIG. 2: the flow chart of the washing method with polymer solid particles in the example 1 of the invention.

The washing method with polymer solid particles will now be described in detail combining with FIG. 2.

The preparation before washing: includes putting the clothes into the inner cylinder, and pouring the polymer solid particles, appropriate amount of water and detergent into inner cylinder and outer cylinder.

Step 1: wash the clothes with polymer solid particles, the surface of the polymer solid particles is provided with absorption holes, the washing process is similar to the general washing machine, the clothes and the washing particles are full rubbing and touching in the inner cylinder, the rotational speed of washing is at 50-70 rpm, the washing time is in the range of 15-60 minutes, preferably in the range of 30-50 minutes, the best washing time is of 40 minutes, the temperature of washing is in cold water, of course, the warm water is also suitable, the temperature of warm water is in the range of 30-70° C.

Step 2: make the polymer solid particles and clothes dehydrate together. Shut off the valve between the inlet of particles storage box 52 of the particles storage box 5 and the outlet of particles in outer cylinder 62 of the outer cylinder 6, open the outfall of the outer cylinder, rotate the inner cylinder with high speed, the outer surface of the inner cylinder is provided with a scraper 14, namely the scraper is arranged between the outer cylinder 6 and the inner cylinder 8, the rotation speed of the inner cylinder is in the range of 1000 to 2000 rpm, the scraper 14 of the inner cylinder drives the polymer solid particles and the clothes to dehydrate under a high-speed centrifugal action.

Step 3: separating the polymer solid particles from the clothes and collecting the polymer solid particles. After washing, shut off the valve 1 between the outlet of particles storage box 51 of the particles storage box 5 and the inlet of particles in outer cylinder 61 of the outer cylinder 6, open the valve between the inlet of particles storage box 52 of the particles storage box 5 and the outlet of particles in outer cylinder 62 of the outer cylinder 6, rotate the inner cylinder with a high speed, on one hand, separate the polymer solid particles from the clothes, on the other hand, under high-speed centrifugal action, the scraper 14 of the inner cylinder drives the polymer solid particles and the clothes to fly out of the outer cylinder along the surface of the outer cylinder through the outlet of particles in outer cylinder 62 and into the particles storage box 5 to be collected, the rotation speed of the inner cylinder is in the range of 200 to 600 rpm.

Step 4: rinse the clothes. Do not need rinse particles. Pour the water to rinse and control the amount of water through flowmeter, the rinsing time is in the range of 3-10 minutes, pour the water and rinse again after dehydrating, finally, dry; namely there is a second rinsing after the first rinsing, if required, there is a third rinsing etc.

Step 5: dehydrate the clothes. Dehydrate the clothes after rinsing, and remove the clothes out after the dehydrating, and the user may also dry the clothes if needed.

The polymer solid particles are wrapped in clothes during the washing process, in order to separate the polymer solid particles from the clothes better, there is a step of separating the polymer solid particles remained in clothes between step 3 and step 4, in other words, separating the polymer solid particles remained in the clothes after separating the polymer solid particles from the clothes and collecting the polymer solid particles in step 3.

When separating the residual polymer solid particles, the clothes locate in the lower part of washing device such as inner cylinder under the gravity action, the cylindrical side wall of the inner cylinder is possessed of metal mesh structure, the first stage, the inner cylinder of the washing device drives the clothes to rotate a preset angle along the circular-arc-shaped side wall of the inner cylinder of the washing machine, as shown in the direction of the arrow A of FIG. 1; the second stage, the inner cylinder stops rotating a preset time, the clothes fall free under the action of the inertia and gravity, as shown in the direction of the arrow B of FIG. 1. Then cycle as follow: the first stage, the second stage, the first stage, the second stage, the first stage, the second stage . . . . In the first stage, the inner cylinder of the washing device drives the clothes to rotate a preset angle along the circular-arc-shaped side wall of the inner cylinder of the washing machine, the clothes are carried to a higher position from a lower position by inner cylinder, then the inner cylinder stops rotating suddenly, the clothes will continue to fly a distance due to the inertia, finally the clothes will fall free for the gravity action. The process of throwing and falling the clothes is similar to shaking the clothes with hands, so the separation of polymer solid particles and the clothes become easy.

The first stage and the second stage mentioned above is one time process of separating the polymer solid particles remained in the clothes, preferably, the process is circulated for 1-50 times, preferably, the process is circulated for 1-30 times.

In addition, the inner cylinder of the washing device drives the clothes to rotate a preset angle along the circular-arc-shaped side wall of the inner cylinder of the washing machine, the angle is of 0°-150°. In order to enhance the effect of separation, the rotation angle of two adjacent process may be different, for example, gradually increasing, the difference of the rotation angle between two adjacent process is the same, it is more than Wand less than 10°, such as in the first time, the rotation angle of the inner cylinder is 5°, in the second time, the rotation angle of the inner cylinder is 10°, in the third time, the rotation angle of the inner cylinder is 15°, in the fourth time, the rotation angle of the inner cylinder is 20°, and the difference of the rotation angle between two adjacent process is 5°. Also the rotation angle between two adjacent process is gradually decreases, and the difference of the rotation angle between two adjacent process is the same, it is more than 0° and less than 10°.

The above is the inner cylinder of the washing device drives the clothes to rotate unidirectionally, the inner cylinder of the washing device also can drive the clothes to rotate alternately along clockwise and anticlockwise, such as a process of separating the residual polymer solid particles comprises the inner cylinder of the washing device drives the clothes to rotate a preset angle along clockwise, and then the inner cylinder stops rotating a preset time; the inner cylinder of the washing device drives the clothes to rotate a preset angle along anticlockwise, and then the inner cylinder stops rotating a preset time, the above process is circulated for 1-30 times.

Or the inner cylinder of the washing device drives the clothes to rotate unidirectionally, and then the inner cylinder of the washing device drives the clothes to rotate alternately along clockwise and anticlockwise. Such as a process of separating the residual polymer solid particles comprises the inner cylinder of the washing device drives the clothes to rotate a preset angle along clockwise, then the inner cylinder stops rotating a preset time; and then the inner cylinder of the washing device drives the clothes to rotate a preset angle along clockwise, then the inner cylinder stops rotating a preset time, and then the inner cylinder of the washing device drives the clothes to rotate a preset angle along anticlockwise, then the inner cylinder stops rotating a preset time, the above process is circulated for 1-30 times.

The above stop time of the inner cylinder is in the range of 1~5 seconds. The clothes is throwed and falled repeatedly in the process of inner cylinder rotating and stopping, therefore the polymer solid particles remained in the clothes are separated easily.

After separating the residual polymer solid particles from the clothes, it need to collect the residual polymer solid particles. The step is similar to the separation process of step 3, open the valve between the inlet of particles storage box 52 and the outlet of particles in outer cylinder 62, rotate the inner cylinder with a high speed, under a high-speed centrifugal action, the scraper 14 of the inner cylinder drives the polymer solid particles 2 between inner cylinder and outer cylinder to fly out of the outer cylinder along the surface of the outer cylinder through the outlet of particles in outer cylinder 62 and into the particles storage box 5 to be collected, the rotation speed of inner cylinder is in the range of 200 to 600 rpm.

It is very easy to separate the polymer solid particles from the clothes through the above method.

Example 2

In order to increase the free choose of the users, embody the humanized design concept, such as there is a sudden blackout when washing, the users do not want to continue to washing the clothes with the washing machine, and want to remove the clothes out, then it need to separate the particles and the clothes. Namely the washing method with the polymer solid particles comprises step 1: washing clothes with polymer solid particles, the surface of the polymer solid particles is provided with absorption holes, step 2: determining whether to collect the polymer solid particles, if yes, separating the polymer solid particles from the clothes and collecting the polymer solid particles. Then remove the clothes out and stop washing.

Figure 3:
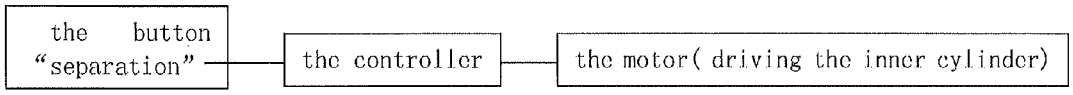
FIG. 3: the schematic block diagram of the separation function in the example 2 of the invention.

Or for the other reasons, such as after the ending of washing, the user find a portion of the particles are not be collected to the particles storage box 5, at this time it need to collect the residual particles. Now the washing method with polymer solid particles comprises step 1: washing clothes with polymer solid particles, the surface of the polymer solid particles is provided with absorption holes; step 2: dehydrating the polymer solid particles and the article to be washed together; step 3: separating the polymer solid particles from the clothes and collecting the polymer solid particles; step 4: determining whether to repeat the step 3, if yes, repeat step 3 at least once. Preferably, the speed of the inner cylinder is in the range of 200-600 rpm during collecting the polymer solid particles in step 3. The specific implementation is that a separate button "separation" is arranged on the operation panel, when pressing this button, as shown in FIG. 3, the controller will control the motor to drive the inner cylinder rotating at the speed of separating polymer solid particles and clothes, the rotation speed of the inner cylinder is at 200-600 rpm, to achieve the separation and collection of the particles and the clothes or collection the polymer solid particles remained in the clothes. In step 2, if the judgment is not, the washing process can refer step 2 to step 5 in the example 1.

Example 3

The present example is a improvement for above two example, in order to easily separate the clothes and the polymer solid particles after washing, the polymer solid particles of present example contains mass percentage of 5%~10% magnetic material.

After washing clothes with the polymer solid particles, the polymer solid particles and the clothes need be separated, but the separation effect of the polymer solid particles and the clothes is not ideal because of the existence of the surface active agent and the water, especially in the automatic cleaning equipment such as the washing machine. Although we can adopt manual separation mode, the washing efficiency will obviously decrease. When adding the magnetic material into polymer solid particles which can be attracted by magnetic field, the polymer solid particles can be separated and fixed on the surface of magnetic field through setting magnetic field in the inner cylinder of the washing machine. It also can avoid the combination of the polymer solid particles and the clothes again after separating, and can improve the separation efficiency of the polymer solid particles and the clothes. In order to avoid magnetic material on the surface of particles to rust and pollute the clothes, it need to remove magnetic material on the surface of solid particles, thus the surface of the polymer solid particles is provided with some open holes.

Magnetic material or the material that can be attracted by the magnetic field is one or two kinds of metal mixture or three kinds of metal mixture selected from the group consisting of iron, cobalt and nickel. In order to reduce the cost and make the separation of the particles and the clothes easy, preferably, the magnetic material is iron or iron alloy.

In order to easily manufacture the solid particles for washing, the magnetic material is granular, the size of the granule is 0.01 mm to 2 mm. At the same time, in order to ensure that the particles are possessed of uniform properties, preferably, the size of the particles is 0.01 mm to 2 mm.

In order to obtain the good washing effect, the average size of the solid particles for washing is in the range of 1 mm~5 mm. Preferably, the average size of the solid particles for washing is in the range of 1 mm~3 mm.

In order to easily separate and recover the polymer solid particles, the magnetism disappeared with the disappearance of the magnetic field, the mass percentage of the magnetic material in the polymer solid particles is of 5%~10%, preferably of 5%, 6%, 7%, 8%, 9% and 10%. The mass percentage of the polymer material in the polymer solid particles is of 50%~95%, preferably of 50%, 60%, 70%, 80%, 90% and 95%.

In present example, the preparation method of the polymer solid particles for washing is: 7 parts by weight of iron granules and 93 parts by weight of PA were mixed uniformly, extruded by the extruder, and granulated by the granulating machine, the abtained particles were soaked in strong acid solution such as hydrochloric acid solution for 30 minutes, so the surface of particles formed many holes because of the dissolving of magnetic material, and finally dried, the polymer solid particles have been abtained.

Figure 4:
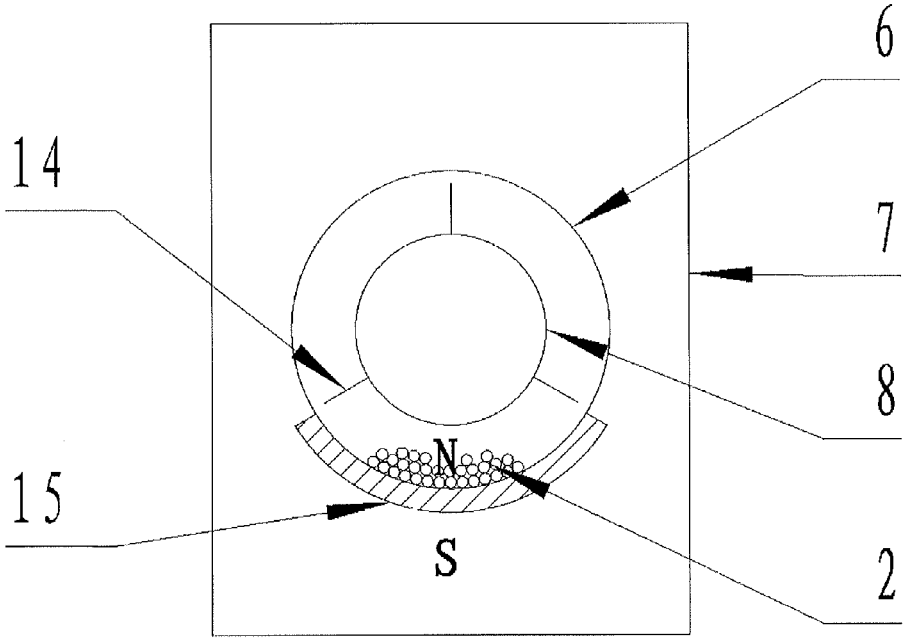
FIG. 4: the schematic illustration of the washing method with polymer solid particles in the example 3 of the invention.

The following describes the washing method of the present example in detail with reference to FIG. 4. In order to easily separate the particles from the clothes, the inside of outer cylinder 6 is provided with magnetic field, the magnetic field is generated by an electromagnet 15, when separating the solid particles from the clothes, the electromagnet will generate the magnetic field, namely the step of separating the polymer solid particles from the clothes in example 1 are carried out in a magnetic field.

When adding the magnetic material that can be attracted by the magnetic field into the polymer solid particles, the magnetic field in outer cylinder can attract the polymer solid particles to the relevant position with the poles of electromagnet in outer cylinder, and the magnetic field is generated by the electromagnet, the magnetic field can be removed when not needed.

Compared with the ordinary polymer solid particles, using the polymer solid particles of invention, the separation time is shortened by 50%~80%, and it can be avoided that the clothes were dyed. So it is easy of separating the polymer solid particles from the clothes after washing clothes with polymer solid particles of the invention, and the washing efficiency was improved.

The above different features and the different examples can freely combine to get the new technical scheme.

What is claimed:

1. A washing method with polymer solid particles performed using a washing device comprising a shell, an outer cylinder, an inner cylinder and a particle storage box, the particle storage box being located above the outer cylinder and being provided with (i) an outlet of the particle storage box through which the polymer solid particles are dispensed into the outer cylinder and (ii) an inlet of the particle storage box through which the polymer solid particles are collected into the particle storage box, the outlet and the inlet of the particle storage box being located above the outer cylinder, the method comprising:

step 1: washing the clothes with the polymer solid particles, wherein the surface of said polymer solid particles is provided with absorption holes;

step 2: dehydrating the polymer solid particles and the clothes together;

step 3: separating the polymer solid particles from the clothes and collecting the polymer solid particles, wherein the outlet of the particle storage box is shut off, the inlet of the particle storage box is open, and the polymer solid particles are separated from the clothes and collected in the particle storage box from the outer cylinder through the inlet of the particle storage box by rotating the inner cylinder;

step 4: rinsing the clothes; and step 5: dehydrating the clothes.

2. The washing method with polymer solid particles according to claim 1, wherein the washing method further comprises another step of adding water and detergent into the polymer solid particles and the clothes before step 1.

3. The washing method with polymer solid particles according to claim 1, wherein, during washing, the rotational speed of the inner cylinder in step 1 is in a range of 50-70 rpm.

4. The washing method with polymer solid particles according to claim 1, wherein washing time in step 1 is in a range of 15-60 minutes.

5. The washing method with polymer solid particles according to claim 1, wherein said polymer solid particles in step 1 contains 5% to 10% magnetic material.

6. The washing method with polymer solid particles according to claim 1, wherein the washing is in cold water.

7. The washing method with polymer solid particles according to claim 1, wherein the speed of the inner cylinder is in a range of 1000-2000 rpm during dehydrating in step 2.

8. The washing method with polymer solid particles according to claim 1, wherein the polymer solid particles and the clothes are separated in a magnetic field in step 3.

9. The washing method with polymer solid particles according to claim 1, wherein the speed of the inner cylinder is in a range of 200-600 rpm during collecting of the polymer solid particles in step 3.

10. The washing method with polymer solid particles according to claim 1, wherein the washing method further comprises a step of separating the polymer solid particles remaining in the clothes between step 3 and step 4, wherein the step of separating the polymer solid particles remaining in the clothes includes cycling through the following steps: the inner cylinder of the washing device drives the clothes to rotate by a preset angle along a circular-arc-shape side wall of the inner cylinder, and then the inner cylinder stops rotating for a preset time.

11. The washing method with polymer solid particles according to claim 10, wherein the inner cylinder of the washing device drives the clothes to rotate unidirectionally; or the inner cylinder of the washing device drives the clothes to rotate alternately along clockwise and anticlockwise; or the inner cylinder of the washing device drives the clothes to rotate unidirectionally, and then the inner cylinder of the washing device drives the clothes to rotate alternately along clockwise and anticlockwise.

12. The washing method with polymer solid particles according to claim 10, wherein the rotation angle that inner cylinder of the washing device drives the clothes is in a range from more than 0° to 150°.

13. The washing method with polymer solid particles according to claim 10, wherein the stop time of the inner cylinder is in the range of 1 to 5 seconds.

14. The washing method with polymer solid particles according to claim 10, wherein the washing method further comprises a step of collecting the polymer solid particles after the step of separating the polymer solid particles remaining in the clothes.

15. The washing method with polymer solid particles according to claim 1, wherein centrifugal action drives the polymer solid particles from a surface of the outer cylinder, through the inlet of the particle storage box, into the particle storage box.

16. The washing method with polymer solid particles according to claim 1, wherein the inner cylinder includes a scraper that drives the polymer solid particles along a surface of the outer cylinder, through the inlet of the particle storage box, into the particle storage box.

17. A washing method with polymer solid particles performed using a washing device comprising a shell, an outer cylinder, an inner cylinder and a particle storage box, the particle storage box being located above the outer cylinder and being provided with (i) an outlet of the particle storage box through which the polymer solid particles are dispensed into the outer cylinder and (ii) an inlet of the particle storage box through which the polymer solid particles are collected into the particle storage box, the outlet and the inlet of the particle storage box being located above the outer cylinder, the washing method comprising:

step 1: washing the clothes with the polymer solid particles, wherein the surface of the polymer solid particles is provided with absorption holes;

step 2: dehydrating the polymer solid particles and the clothes together;

step 3: separating the polymer solid particles from the clothes and collecting the polymer solid particles, wherein the outlet of the particle storage box is shut off, the inlet of the particle storage box is open, and the polymer solid particles are separated from the clothes and collected in the particle storage box from the outer cylinder through the inlet of the particle storage box by rotating the inner cylinder; and step 4: determining whether to repeat step 3, if yes, repeating step 3 at least once.

18. The washing method with polymer solid particles according to claim 17, wherein centrifugal action drives the polymer solid particles from a surface of the outer cylinder, through the inlet of the particle storage box, into the particle storage box.

19. The washing method with polymer solid particles according to claim 17, wherein the inner cylinder includes a scraper that drives the polymer solid particles along a surface of the outer cylinder, through the inlet of the particle storage box, into the particle storage box.

* * * * *